United States Patent [19]

Yuasa

[11] 4,325,351

[45] Apr. 20, 1982

[54] COACTING WHEEL BALL EMITTING DEVICE OF TENNIS TRAINING SYSTEM

[76] Inventor: Sueto Yuasa, 5-9-10, Seta, Setagaya-ku, Tokyo, Japan

[21] Appl. No.: 114,562

[22] Filed: Jan. 23, 1980

[30] Foreign Application Priority Data

Jan. 30, 1979 [JP] Japan ..... 54-10599[U]

[51] Int. Cl.[3] ..... F41B 15/00

[52] U.S. Cl. ..... 124/78; 124/51 A; 124/81

[58] Field of Search ..... 124/78, 41 R, 81, 82, 124/83, 1, 51 A; 273/26 D

[56] References Cited

U.S. PATENT DOCUMENTS

| | | | |
|---|---|---|---|
| 3,538,900 | 11/1970 | Samuels | 124/78 |
| 3,794,011 | 2/1974 | Newgarden | 124/78 |
| 4,086,903 | 5/1978 | Scott | 124/78 |

*Primary Examiner*—Richard C. Pinkham
*Assistant Examiner*—William R. Browne
*Attorney, Agent, or Firm*—Thomas R. Morrison

[57] ABSTRACT

A tennis ball emitting or serving device includes a ball emitting cylinder having controllable horizontal and vertical angles. The ball is driven by contact with the peripheral surfaces of rotating ball emitting wheels or pulleys. To impart various directions and speeds of spin to the ball, the ball emitting wheels may be rotated at various speeds and the axes of the wheels may be independently disposed at variable angles.

1 Claim, 4 Drawing Figures

COACTING WHEEL BALL EMITTING DEVICE OF TENNIS TRAINING SYSTEM

CROSS REFERENCE TO RELATED APPLICATIONS

This invention is related to U.S. Patent Application Ser. Nos. 097,783 and 097,859 filed Nov. 27, 1979, respectively, by the applicant herein. These related applications disclose tennis emitting devices as does the present application.

BACKGROUND OF THE INVENTION

1. Field of the Invention

The present invention relates to a ball emitting device for a tennis training system and more particularly to an improvement in this ball emitting device.

2. Description of the Prior Art

In the devices of the related applications, horizontally and vertically inclined angles of the ball emitting cylinder are controlled to adjust the flying distance and direction of an emitted tennis ball with the result that a tennis player is given improved practice in ball hitting technique.

In the ball emitting devices disclosed in the related patent applications, the ball can be naturally launched with a spin. However, the direction of this spin normally has a direction perpendicular to the court surface or the like and hence it provides a rather simple or monotonous repetition with respect to spin.

SUMMARY OF THE INVENTION

An object of the present invention, therefore, is to provide a novel ball emitting device of tennis a training system in which a spin applied to emitted balls can take various directions or inclined angles relative to the court surface.

According to a feature of this invention, a ball emitting device of a tennis training system is composed of a ball emitting cylinder, means for controlling horizontal and vertical rotation of the ball emitting cylinder; upper and lower ball emitting pulleys partially protruding into the ball emitting cylinder through the upper and lower peripheral surfaces thereof. The peripheral speeds of the pulleys are made variable by means of respective motors. A supporting member is provided for rotatably supporting the ball emitting cylinder. A base plate fixed to the ball emitting cylinder provides a mounting for the motors of the ball emitting pulleys. A inclined angle control means is disposed between the supporting member and the base plate, whereby the inclined angles of the axes of the ball emitting pulleys are adjusted to drive emitting balls with spin motion in various directions.

The other objects, features and advantages of the present invention will be apparent from the following description taken in conjunction with the accompanying drawing.

DESCRIPTION OF THE PREFERRED EMBODIMENT

Figure 1:
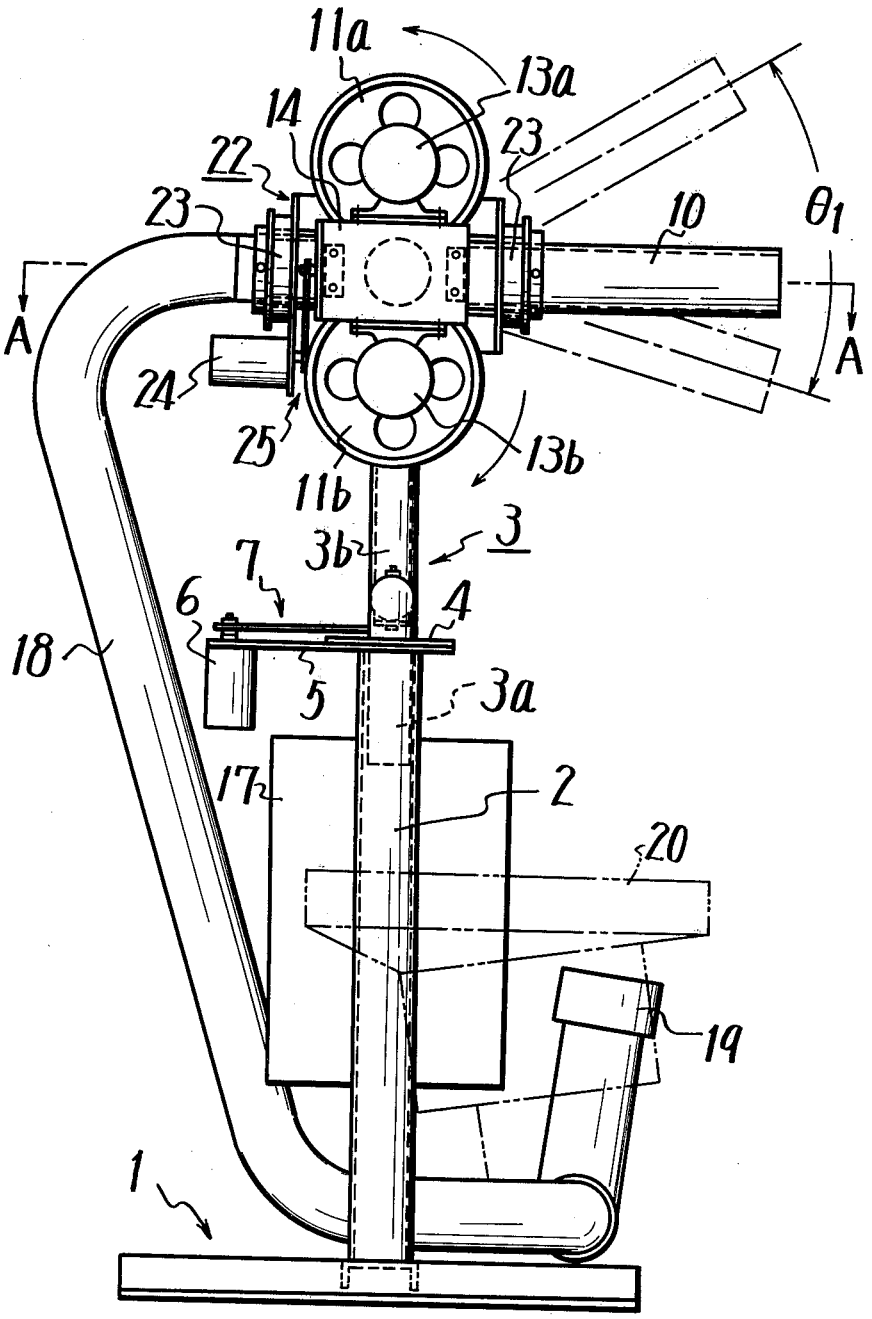
FIG. 1 is a diagrammatical view of essential parts showing one embodiment of a ball emitting device of a tennis training system according to this invention.

A description will hereinafter be given of one embodiment of a tennis ball emitting device of this invention with reference to the drawing.

Figure 2:
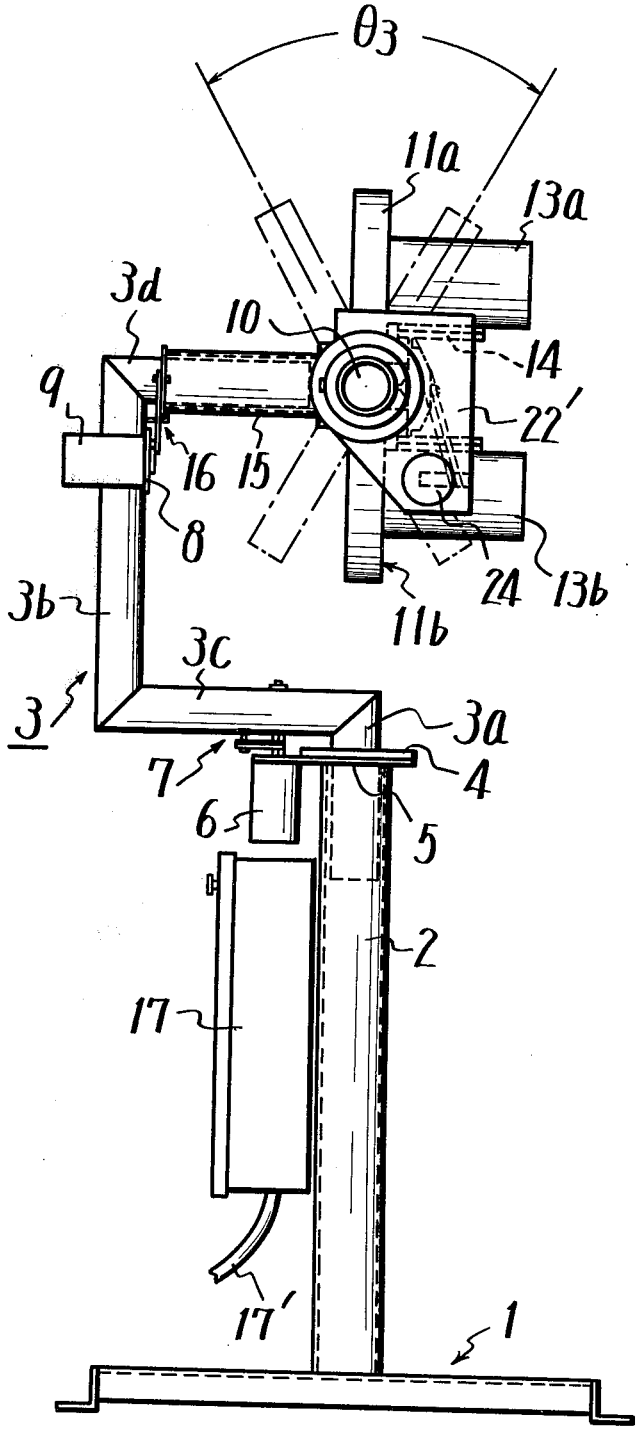
FIG. 2 is a rear view of the ball emitting device shown in FIG. 1.

In FIGS. 1 and 2, 1 designates a supporting base made of steel or the like, 2 a cylindrical column erected on the base 1, and 3 a crank member. The crank member 3 consists of vertical portions 3*a*, 3*b* and horizontal portions 3*c*, 3*d*. The vertical portion 3*a* is rotatably journalled in the upper end of the cylindrical column 2 and provided with a flange 4 which functions as a stopper to limit the engaged position of the vertical position 3*a*. At the upper end of the cylindrical column 2 there is mounted a motor mounting plate 5, and a motor 6 for horizontal rotation is secured to the lower surface of the free end of the motor mounting plate 5. The motor 6 serves to rotate the crank member 3 in a horizontal direction through a link member 7 disposed between the mounting plate 5 and the horizontal portion 3*c* of the crank member 3. Reference numeral 8 indicates a motor mounting plate which is fixed to the vertical portion 3*b* of the crank member 3 to support a motor 9 for vertical rotation at its one surface. The horizontal and vertical rotating motors 6 and 9 are of low speed and rotatable in forward and reverse directions by reversing the input current fed to these motors. That is, these motors function to minutely control horizontally inclined angle and vertically inclined angle of a ball emitting cylinder, which will be described later. If the input currents fed to these motors are reversed, it is possible to reverse the rotating directions of these motors and hence to correct the inclined angle of a ball emitting cylinder in the opposite direction.

Figure 4:
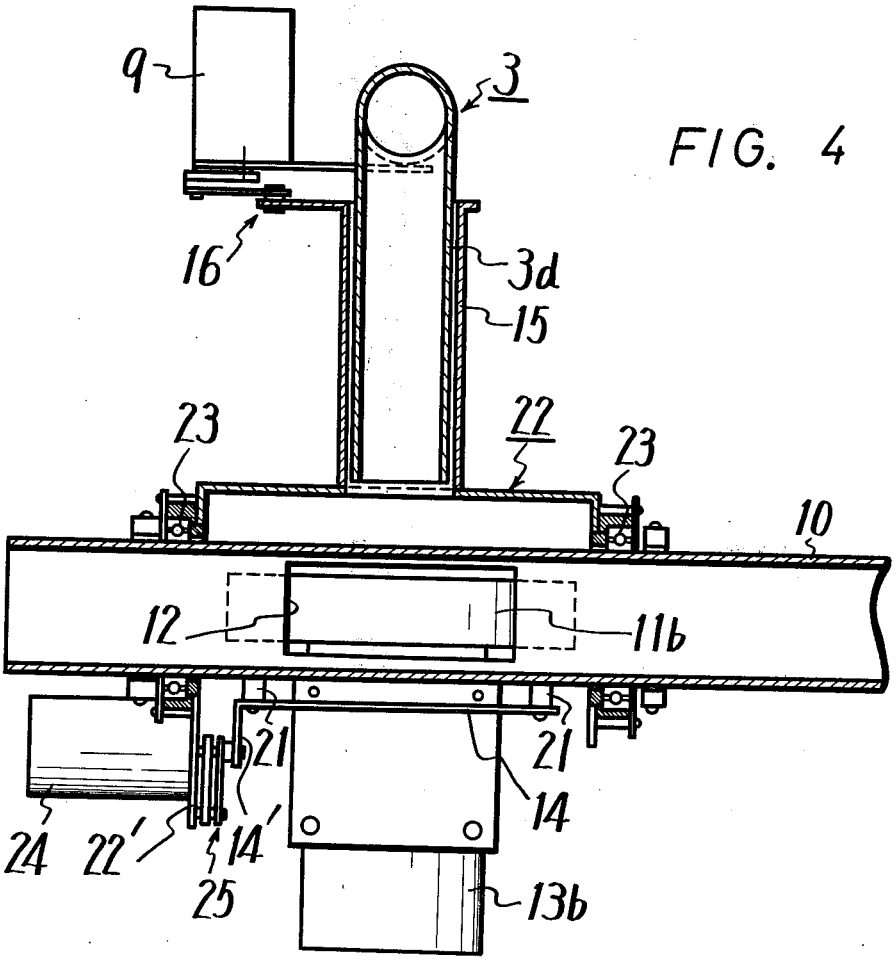
FIG. 4 is a cross-sectional view of the ball emitting device on line A—A in FIG. 1.

In FIGS. 1 and 2, 10 represents a ball emitting cylinder, 11*a* and 11*b* upper and lower ball emitting pulleys located at the up and down sides of the cylinder 10, each pulley having a peripheral portion partially protruding into the ball emitting cylinder 10 through a corresponding one of slits 12 (refer to FIG. 4) formed in the upper and lower peripheral surfaces thereof (such ball emitting means is well known), 13*a* and 13*b* upper and lower pulley driving motors, 14 a mounting base plate secured to the ball emitting cylinder 10 for mounting the driving motors 13*a* and 13*b*, and 15 a cylinder secured to a ball emitting cylinder supporting member, which will be described later. The cylinder 15 engages the horizontal portion 3*d* of the crank member 3 and is connected through a link member 16 to the vertical rotating motor 9 as shown in FIGS. 2 and 4.

Figure 3:
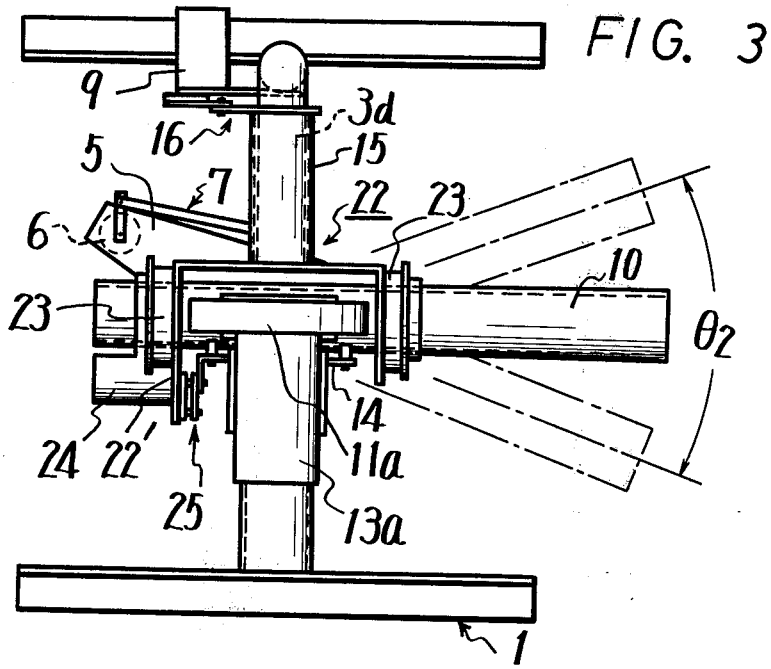
FIG. 3 is a plan view of the ball emitting device shown in FIG. 1.

The ball emitting ability and methods of adjusting the vertically and horizontally inclined angles of the ball emitting cylinder 10 ($\theta_1$ in FIG. 1 and $\theta_2$ in FIG. 3) or the like can be understood if referred to the above description. Each of the upper and lower ball emitting pulleys 11*a* and 11*b* is provided around its outer periphery with a rubber tire. Since the peripheral speed of each pulley can be changed by controlling the input voltages applied to the driving motors 13*a* and 13*b*, it is possible to apply a desired spin to balls before emission. In FIG. 2, 17 designates an electric supply source box secured to the cylindrical column 2, and 17′ a cable which is led from the electric supply source box 17 to a remote control panel (not shown).

Further, in FIG. 1, 18 designates a ball feeding flexible hose which is connected to the end of the ball emitting cylinder 10, and 19 a blower which is coupled to the hose 18 and generates a wind pressure to transfer balls into the hose 18. There is also provided a ball delivering unit 20 shown by two-dot chain lines, which functions to deliver a ball at every constant time into the flexible hose 18 at its base portion. However, this unit 20 has already been described in the aforesaid related applications and hence its detailed description will be omitted.

As mentioned above, this invention is designed to apply spin to a ball emitted from, for example, the ball emitting device as mentioned above at a desired angle. In order to achieve the above object, there are provided the mounting base plate 14, which is secured to the ball emitting cylinder 10 through, for example, bosses 21 as shown in FIG. 4, and a supporting member 22 for rotatably supporting the ball emitting cylinder 10, thereby controlling the inclined angle of the base plate 14 relative to the supporting member 22. Thus, the inclined angles of the ball emitting pulleys 11*a* and 11*b* are adjusted to have for example, an angular range of $\theta_3$ on both sides of the perpendicular as shown in FIG. 2, so that the spin of emitted balls may be variously selected.

In the embodiment of this invention, the emitting cylinder supporting member 22 has a U-shaped plan configuration and is normally provided with ball bearings 23 at its both side plates, for example, at the outer sides thereof to support the emitting cylinder 10 at its predetermined axial position. A rear side plate 22' of the supporting member 22 is extended downward and a low speed reversible control motor 24, similar to the above mentioned rotating motors, is secured to the outer surface of the thus extended plate 22'. In addition, a link member 25 is disposed between the downward extended rear side plate 22' and a bent plate 14' of the base plate 14. The motor 24 is connected to the electric supply source box 17.

With the construction as mentioned above, the operation and effect of the ball emitting device of this invention will be understood clearly. That is, in addition to the control of the ball emitting cylinder 10 in its horizontal and vertical rotations, inclined angles of the ball emitting pulleys 11*a* and 11*b* relative to the surface of tennis court can be almost freely selected and controlled, so that emitted balls can be spun or rotated in various directions. Accordingly, players who utilize the tennis training system can enjoy a great deal of benefits in learning the technical skill of the game.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

I claim as my invention:

1. A ball emitting device comprising:

(a) a ball emitting cylinder;

(b) means for controlling horizontal and vertical rotation of said ball emitting cylinder;

(c) a supporting member for rotatably supporting said ball emitting cylinder;

(d) said supporting member having a rear plate extending downward therefrom;

(e) a control motor mounted on an outer surface of said rear plate and driven at a low speed in forward and backward directions;

(f) first and second side plates on said supporting member having first and second aligned bearings therein respectively for supporting said ball emitting cylinder at a predetermined axial position thereof;

(g) a base plate fixed to said ball emitting cylinder;

(h) said base plate having at least one bent portion bent at a substantial angle to the remainder thereof;

(i) upper and lower motors on said base plate, speeds of said upper and lower motors being independently variable;

(j) upper and lower ball emitting pulleys affixed respectively to said upper and lower motors;

(k) perimeters of said upper and lower ball emitting pulleys particularly protruding into opposed locations in said ball emitting cylinder through openings in upper and lower peripheral surfaces thereof thereby to drivingly emit balls from said ball emitting cylinder with variable speed and variable spin speed; and (l) inclined angle control means including said control motor and a link member driven by said control motor said link member being disposed between said rear plate and said bent portion and connected to said bent portion, said inclined angle control means being effective to control inclined angles of axes of said ball emitting pulleys to impart variable spin direction to emitted balls.

* * * * *